US007612273B2

(12) United States Patent
Matsuyuki et al.

(10) Patent No.: US 7,612,273 B2
(45) Date of Patent: Nov. 3, 2009

(54) ELECTRONIC PERCUSSION INSTRUMENT

(75) Inventors: Hirotaka Matsuyuki, Hamamatsu (JP); Kiyoshi Yoshino, Hamamatsu (JP); Masato Katsuda, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 96 days.

(21) Appl. No.: 11/514,805

(22) Filed: Sep. 1, 2006

(65) Prior Publication Data

US 2007/0234886 A1 Oct. 11, 2007

(30) Foreign Application Priority Data

Mar. 20, 2006 (JP) ..... 2006-076441
Mar. 20, 2006 (JP) ..... 2006-076442

(51) Int. Cl.
*G10D 13/02* (2006.01)
*G10H 3/12* (2006.01)
*G10H 1/32* (2006.01)

(52) U.S. Cl. ..... 84/411 R; 84/411 A; 84/420; 84/723; 84/730

(58) Field of Classification Search ..... 84/411 A, 84/411 R–417, 412, 413, 414, 420, 723, 730
See application file for complete search history.

(56) References Cited

U.S. PATENT DOCUMENTS 3,509,264 A * 4/1970 Green ..... 84/725
3,659,032 A * 4/1972 May ..... 84/600
4,048,895 A * 9/1977 May ..... 84/411 A
4,122,748 A * 10/1978 May ..... 84/411 A
4,168,646 A * 9/1979 May ..... 84/723
4,242,937 A * 1/1981 Pozar ..... 84/725
4,254,685 A * 3/1981 Rose ..... 84/414
4,475,434 A * 10/1984 Willis ..... 84/411 R
4,714,002 A * 12/1987 Cleland ..... 84/413
4,798,121 A * 1/1989 Donohoe ..... 84/414
4,947,725 A * 8/1990 Nomura ..... 84/723
4,998,960 A * 3/1991 Rose et al. ..... 84/622
5,042,356 A * 8/1991 Karch ..... 84/725
5,105,710 A * 4/1992 Rothmel ..... 84/730
5,430,245 A * 7/1995 Rogers ..... 84/725
5,915,289 A * 6/1999 Hart ..... 84/738
6,069,307 A * 5/2000 Rogers ..... 84/411 R
6,365,812 B1 * 4/2002 McGill ..... 84/414
6,580,023 B2 * 6/2003 Belli ..... 84/411 R
6,686,526 B2 * 2/2004 Ezbicki ..... 84/411 R
6,753,467 B2 * 6/2004 Tanaka et al. ..... 84/723
6,756,535 B1 * 6/2004 Yoshino et al. ..... 84/738
6,765,139 B2 * 7/2004 Belli ..... 84/411 R
6,784,352 B2 * 8/2004 Suenaga ..... 84/411 R
6,916,977 B2 * 7/2005 Hagiwara ..... 84/411 R (Continued)

FOREIGN PATENT DOCUMENTS

JP 2003-173186 6/2003

(Continued)

*Primary Examiner*—David S. Warren
(74) *Attorney, Agent, or Firm*—Foley & Lardner, LLP

(57) ABSTRACT

An electronic percussion instrument that detects vibrations due to a hit and outputs a corresponding signal where the head of the instrument is held in place independent of a rim part. The independence stops vibrations originating from a hit of the rim from traveling to the head and interfering with the proper signal detection of hits to the head part.

37 Claims, 5 Drawing Sheets

U.S. PATENT DOCUMENTS

| | | | | |
|---|---|---|---|---|
| 6,921,857 | B2 * | 7/2005 | Yoshino et al. | 84/738 |
| 7,074,994 | B2 * | 7/2006 | Belli | 84/411 R |
| 7,074,996 | B2 | 7/2006 | Simons et al. | |
| 2003/0029301 | A1 * | 2/2003 | Belli | 84/411 R |
| 2003/0037660 | A1 * | 2/2003 | Suenaga | 84/411 R |
| 2003/0070533 | A1 * | 4/2003 | Ezbicki | 84/411 R |
| 2003/0136244 | A1 * | 7/2003 | Okumura | 84/411 R |
| 2004/0016336 | A1 * | 1/2004 | Hagiwara | 84/412 |
| 2004/0094015 | A1 * | 5/2004 | Simons et al. | 84/411 R |
| 2004/0103774 | A1 * | 6/2004 | Belli | 84/411 R |
| 2005/0022655 | A1 * | 2/2005 | Wise | 84/743 |
| 2005/0109190 | A1 * | 5/2005 | Smith et al. | 84/414 |
| 2005/0223880 | A1 * | 10/2005 | Yoshino et al. | 84/738 |
| 2005/0262991 | A1 * | 12/2005 | Arimoto | 84/735 |

FOREIGN PATENT DOCUMENTS

| | | |
|---|---|---|
| JP | 2004-198657 | 7/2004 |
| JP | 2005-195928 | 7/2005 |
| WO | WO 2004/015681 A1 | 2/2004 |

* cited by examiner (a)

(b)

(a)

B-B (b)

ELECTRONIC PERCUSSION INSTRUMENT

CROSS-REFERENCE TO RELATED PATENT APPLICATIONS

This application claims priority to Japanese patent application No. 2006-076441 (filed on Mar. 22, 2006 in Japan), which was assigned to the applicant and is incorporated herein by reference, in its entirety.

BACKGROUND OF THE INVENTION

1. Field of the Invention

Embodiments of the present invention relate to electronic percussion instruments, in particular to an electronic percussion instrument that has a rim part separate from a hoop part that imparts tension to the head and a method of arranging the rim part, hoop part, and head part forming an electronic percussion instrument.

2. Related Art

Various electronic percussion instruments have been proposed, including electronic drums based on acoustic drums. These electronic drums have been formed such that a sensor detects the vibrations occurring when the electronic drum is hit. The detected signal from the sensor controls a sound source that forms musical notes in proportion to the force of the hit.

Methods for playing an acoustic drum have included the ordinary playing method of hitting only the surface (head) and the rim shot playing method. The rim shot playing method generally includes two types of playing methods: the open rim shot where the rim and the hitting surface (head) are hit simultaneously creating the drum's unique harmonic overtone effect, and the closed rim shot where only the rim is hit creating the "katsu-katsu" percussive sound.

As a result, previous embodiments of electronic percussion instruments comprise a head used as a hitting surface positioned on the upper surface of a hollow body part, a head sensor that detects the vibrations due to hits to the head, and a rim sensor that detects the vibrations due to hits to the rim, allowing for the reproduction of a rim shot based on the signals detected by these two sensors.

In the structure described above, the outer circumference of the head is secured with screws that extend through the rim and into the body part. Therefore, when adjusting the tension of the head, the distance between the head and the tip of the rim changes, and playing a rim shot becomes difficult. For example, when the head is new, the distance between the upper surface of the head and the tip of the rim is relatively substantial. However, when the head stretches from use, screws that impart tension to the head are turned to maintain tension. When this is done, the distance between the tip of the rim and the upper surface of the head decreases. The changed distance makes hitting the rim with the central part of a stick while at the same time hitting the upper surface of the head with the tip of the stick in order to play a rim shot more difficult.

Furthermore, with the rim attachment structure described above, when the rim is hit strongly, the rim part is pushed downward, causing the force applied to the screws that impart tension to the head to change for a moment. The change in force tends to loosen the screws.

In addition, there is the problem that in the embodiments where the outer circumference of the head is screwed into the body part through the rim, when the rim is hit, the vibration is transmitted to the head and the head sensor detects the vibration of the head from the rim shot. It is therefore difficult to accurately detect a hit to the head and a hit to the rim independently, and a player cannot obtain the musical note intended.

In addition, a problem arises in embodiments where the head sensor is placed substantially in the center of the body part, and vibrations are detected via a cushion placed in the central part of the head. When the area directly above the cushion is hit, a larger output is detected and the detected output decreases the further away from the center the head is hit. Consequently, even if a player hits the head with the same strength, the size of the output obtained differs depending on the location of the hit. In the case of a percussion instrument, a change of the sound volume or tone quality, called a wide dynamic range, should be produced in response to the force of a hit. In the above-mentioned embodiment where the size of the vibrations that can be detected differs depending on the location of the hit, it is difficult to ensure a wide dynamic range.

SUMMARY OF THE DISCLOSURE

Embodiments of the present invention may be configured to address the above-mentioned problems. One embodiment comprises an electronic percussion instrument that can accurately detect the strength of a hit and is easy to play.

More particularly, an electronic percussion instrument according to a first preferred embodiment detects vibrations due to a hit and outputs a corresponding signal, and comprises a body, a head, a head support member, a hoop, and a head sensor. The body has a hollow circular cylindrical shape with a rim part on the outer circumference of the body. The head, which has an inner and an outer circumference, has a flat surface positioned lower than the upper circumference of the rim part. The head support member has a cylindrical shape and is positioned on the inner side of the cylinder formed by the body, and contacts the inner circumference of the lower surface of the head. The hoop, surrounds the outer circumference of the head and provides tension to the head. The head sensor detects the vibrations of the head. Since tension is applied to the head by the hoop, the height of the upper edge of the rim part from the upper surface of the head can be held constant because the change in height from force applied to the rim is prevented. Accordingly, a rim shot can be played more easily.

Furthermore, since the hoop is located on the inner circumference of the body, the outer circumference of the head may be made smaller. Therefore the cost of the head can be made smaller.

An electronic percussion instrument in a second preferred embodiment, comprises an electronic percussion instrument of the first embodiment, but with the upper surface of the hoop approximately flush with the upper surface of the head. Since the upper surface of the hoop is approximately flush with the upper surface of the head, the upper surface of the head and the upper surface of the hoop appear to form a uniform head surface. Accordingly, the hitting surface appears larger than the surface of the actual head and may be easier to hit.

An electronic percussion instrument in a third preferred embodiment, comprises an electronic percussion instrument of the first embodiment, but with the hoop secured by means of a plurality of bolts to a plurality of internal threads formed in a frame connected to the head support member. This can provide the advantageous result that, by adjusting the bolts, the tension imparted to the head can be easily adjusted and, since the hitting force with which the rim part is hit does not act on the hoop, the bolts do not loosen.

An electronic percussion instrument in a fourth preferred embodiment comprises an electronic percussion instrument of the third embodiment, but wherein the hoop has bolt head accommodating holes so that the heads of the bolts do not protrude from the upper surface of the hoop. This can provide the advantageous result that the head surface appears to form a uniform surface that includes the upper surface of the hoop, making use easier.

An electronic percussion instrument in a fifth preferred embodiment comprises an electronic percussion instrument of the first embodiment, but with the body and head support member formed in one body by means of resin. This can provide the advantageous result that the body and head support member can be made inexpensively.

An electronic percussion instrument in a sixth preferred embodiment comprises an electronic percussion instrument of the first embodiment, but with a rim sensor that detects the vibrations of the body in the vicinity of the head sensor. This can provide the advantageous effect that a hit to the head and hit to the rim part can each be detected independently. In former electronic percussion instruments, tension was imparted to the head by the rim, so a hit inflicted on the rim was also transmitted directly to the head, and detected by the head sensor. According to the sixth embodiment of the present invention, a hit to the rim part need not be transmitted directly to the head, leading to better detection of a hit to the rim part.

An electronic percussion instrument in a seventh preferred embodiment comprises an electronic percussion instrument of the first embodiment, but with an attaching part that holds the body part positioned on the outer circumference of the body part. Additionally, the head sensor is positioned on the side opposite the attaching part with the central part of the body interposed between. This can provide the advantageous result that the head sensor is positioned close to the player.

Accordingly, when a player holds a stick and the like in his or her hand and hits the head, there are few hits directly above the head sensor or in the vicinity thereof because the upper edge of the rim is higher than the head surface. Therefore, there is the advantageous result that the hitting force detected by the head sensor does not greatly differ depending on the hitting position, and the hitting force can be accurately detected.

Furthermore, on a drum stand, a plurality of electronic percussion instruments such as a tom and cymbal may be assembled, and the vibrations of other electronic percussion instruments that are hit are transmitted to the drum stand causing the drum stand to vibrate. Since the head sensor is placed in a position far from where the drum stand is assembled, there can be the advantageous result that the head sensor is not subjected to the influence of the vibrations transmitted via the drum stand, due to another electronic percussion instrument being hit.

An electronic percussion instrument in an eighth preferred embodiment comprises an electronic percussion instrument of the first embodiment, but wherein the head is made of mesh knitted out of vertical threads formed from synthetic resin and horizontal threads that are at an angle to those vertical threads. This can provide the advantageous result that the volume of the acoustic musical note that the head generates through vibration is small and only the musical note electronically generated by the sound source can be heard. When the hitting surface is made of rubber and the like, an unpleasant sound is generated by hitting the hitting surface, but the use of mesh can prevent the unpleasant sound.

An electronic percussion instrument in a ninth preferred embodiment comprises an electronic percussion instrument of the eighth embodiment, but wherein the head comprises two layers of mesh. This can provide the advantageous result that a strong tension can be applied to the mesh, which makes for a better feeling hitting surface, such as with regards to rebounding.

An electronic percussion instrument in a tenth embodiment comprises an electronic percussion instrument that detects vibrations due to a hit and outputs a corresponding signal, and includes a body part, a head, an attaching part, and a head sensor. The body has a hollow circular cylindrical shape with a rim part on the outer circumference of the body. The head, which has an inner and an outer circumference, has a flat surface positioned lower than the upper edge of the rim part. The attaching part holds the body part and is positioned on the outer circumference of the body part. The head sensor detects the vibration of the head and is located on the side opposite the attaching part with the central part of the cylinder of the body interposed between. Therefore, when the electronic percussion instrument is attached to the drum stand via the attaching part, the head sensor may be placed in a position close to the player.

Accordingly, when a player holds a stick and the like in his or her hand and hits the head, there may be few hits directly above the head sensor or in the vicinity thereof because the upper edge of the rim is higher than the head surface. Therefore, there can be the advantageous result that the hitting force detected by the head sensor does not greatly differ depending on the hitting position, and the hitting force can be accurately detected.

Furthermore, on a drum stand a plurality of electronic percussion instruments such as a tom and cymbal may be assembled, and the vibrations of other electronic percussion instruments that are hit may be transmitted to the drum stand causing the drum stand to vibrate. Since the head sensor is placed in a position far from the position in which the drum stand is assembled, the effect of the vibration of the drum stand on the head sensor is reduced.

An electronic percussion instrument in an eleventh preferred embodiment comprises an electronic percussion instrument of the tenth embodiment, but with a rim sensor that detects the vibrations of the body placed in the vicinity of the head sensor. This can provide the advantageous result that even when the hitting position of the head and the hitting position of the rim have been changed, the proportions or differences of the output of the rim sensor and the output of the head sensor are substantially uniform. Accordingly it can be easily determined when only the head has been hit, when only the rim has been hit, when both the rim and the head have been hit, and the like.

Furthermore, on a drum stand a plurality of electronic percussion instruments such as a tom and cymbal may be assembled, and the vibrations of other electronic percussion instruments that are hit may be transmitted to the drum stand causing the drum stand to vibrate. Since the rim sensor is placed in a position far from the position in which the drum stand is assembled, the effect of the vibration of the drum stand on the rim sensor is reduced.

An electronic percussion instrument in a twelfth preferred embodiment comprises an electronic percussion instrument of the tenth embodiment, but wherein the head is made of mesh knitted out of vertical threads formed from synthetic resin and horizontal threads that are at an angle to those vertical threads. This can provide the advantageous result that the volume of the acoustic musical note that the head generates through vibration is small and only the musical note electronically generated by the sound source can be heard. When the hitting surface is made of rubber and the like, an unpleasant sound is generated by hitting the hitting surface, but the use of mesh prevents the unpleasant noise.

An electronic percussion instrument in a thirteenth preferred embodiment, comprises an electronic percussion instrument of the twelfth embodiment, but wherein the head comprises two layers of mesh. This can provide the advantageous result that a strong tension can be applied to the mesh, which makes for a better feeling hitting surface, such as with regards to rebounding.

DETAILED DESCRIPTION OF PREFERRED EMBODIMENTS

Below, preferred embodiments of the present invention will be explained with reference to the attached drawings. An electronic percussion instrument 1 according to an example embodiment of the present invention is an electronic percussion instrument referred to as an "electronic drum" that is played using sticks and the like, provided with sensors that detect vibrations due to hits. Musical note equipment (not shown) controls a sound source based on the signals detected by the sensors and is designed so as to generate musical notes or sounds in proportion to the hits. The musical notes or sounds are output from speaker equipment via amplifier equipment.

Figure 1:
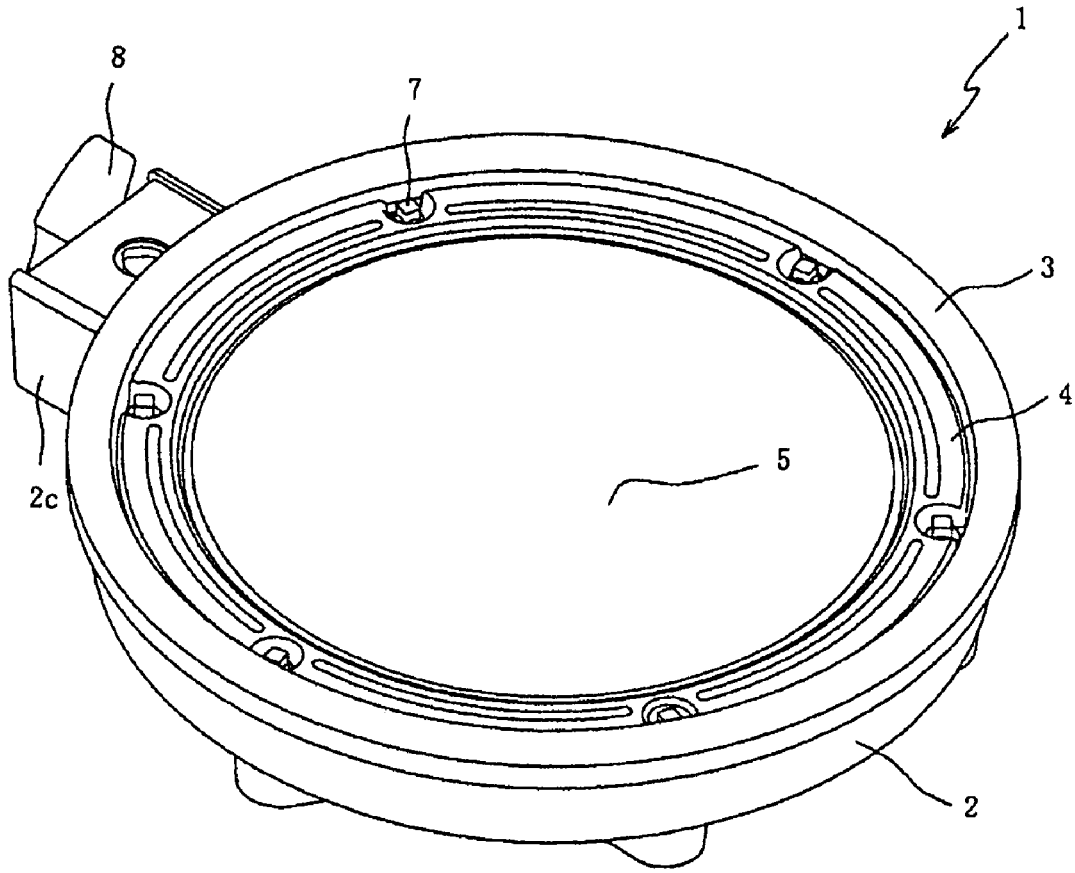
FIG. 1 is an external perspective view of an electronic percussion instrument according to one embodiment of the present invention.

FIG. 1 is an external perspective view of an electronic percussion instrument 1 according to one embodiment of the present invention. The exterior of electronic percussion instrument 1, as shown in FIG. 1, is provided with a body part 2, a rim cover 3, a hoop 4, and a head 5.

Figure 2:
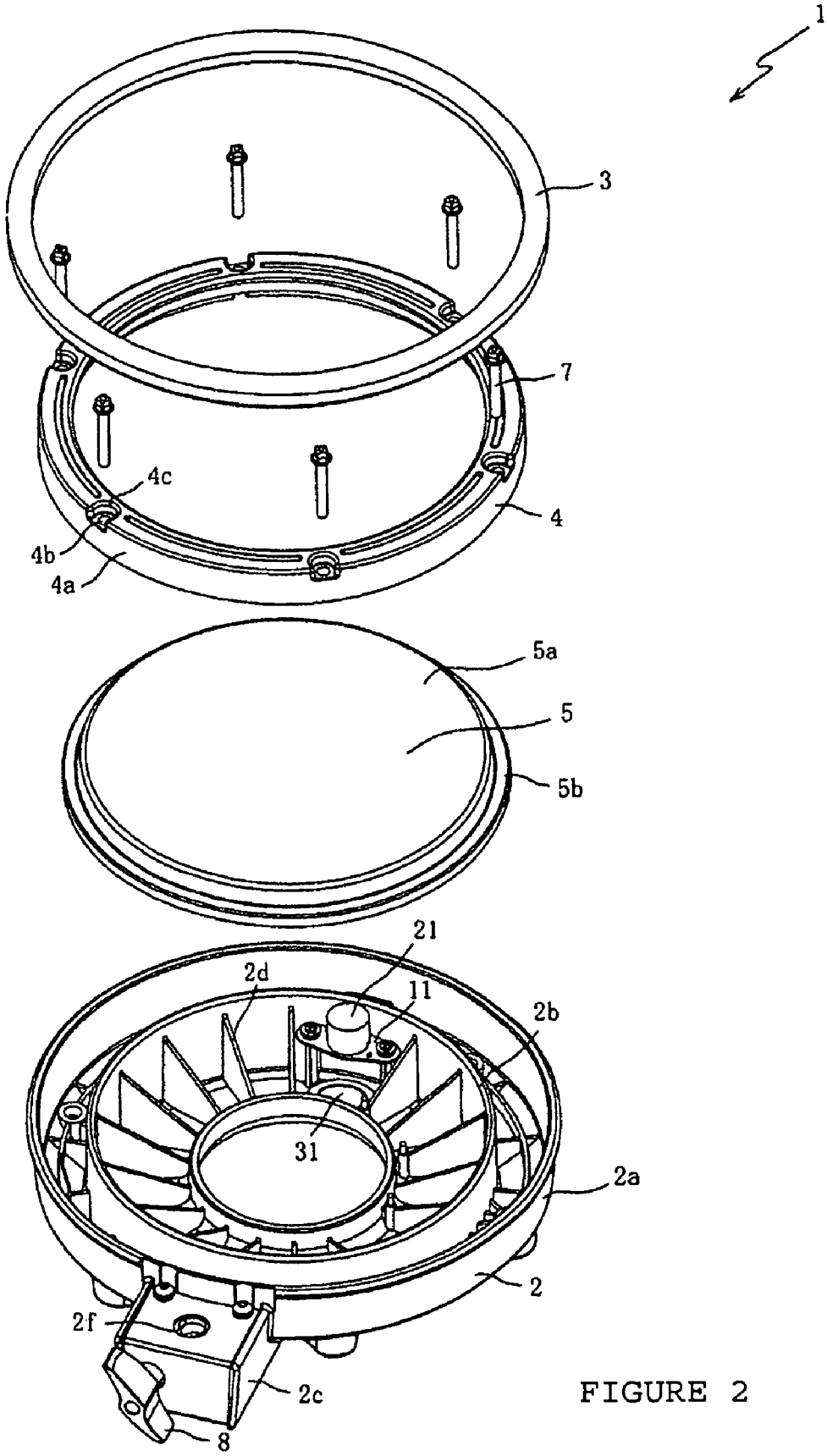
FIG. 2 is an exploded perspective view of the electronic percussion instrument of FIG. 1.

FIG. 2 is an exploded perspective view that shows these parts in a disassembled state. By screwing in and fixing the hoop 4, tension is applied to the head 5 and it is fixed in place. The rim cover 3 is fit onto the outer circumferential part 2*a* of the body part 2.

The body part 2 forms a framework of the electronic percussion instrument 1 and, in the embodiment shown in FIG. 2, is formed in an approximately hollow cylindrical shape from a resin material. The outer circumference of the body part 2 is formed in a cylindrical shape with the outer circumferential part 2*a* erected almost vertically from the bottom part 2*g* (refer to FIG. 4). The rim cover, in this embodiment, is fit on the periphery of the upper edge of the outer circumferential part 2*a* forming the rim part.

In the inner circumference of the outer circumferential part 2*a*, a head support member 2*b* is formed as one unit, with the bottom part 2*g* and the outer circumference part 2*a*, and is arranged in a standing manner from the bottom part 2*g*. The unit forms a cylindrical shape of concentric circles with the outer circumference part 2*a*. The head support member 2*b* is supported by a plurality of ribs 2*d*, in this embodiment, arranged in a standing manner perpendicular to the bottom part 2*g*. The ribs 2*d* are formed in the body part 2 as shapes radiating from the central direction of the cylinder. Furthermore, in the central part of the cylinder of the bottom part 2*g*, circular holes 2*h* are formed and the air inside the body part 2 can freely go outside.

The lower surface of the head 5 contacts the upper edge circumference of the head support member 2*b*, and the ring shaped hoop 4 surrounds the outer circumference of the head while imparting tension to the head 5.

The rim cover 3, in this embodiment, comprises a cylindrical shaped cover made of rubber, soft plastic, or the like, fit onto the upper edge of the perimeter of the body part 2 . The rubber makes hitting the rim with the shaft and the like of a stick feel softer because the rubber covering is more flexible than the body part 2, which is made of hard resin. Furthermore, the rim part corresponds to the part comprising the rim cover 3 and the outer circumference part 2*a*.

The hoop 4, in this embodiment, comprises the bolt holes 4*b* into which the joining bolts 7 are inserted, and the bolt head accommodating holes 4*c* (or recesses) that receive the heads of the joining bolts 7. The bolt holes 4*b* and bolt head accommodating holes 4*c* divide the circumference of the hoop 4 into a plurality (for example six) equal parts on the hoop main body 4*a* that contacts the ring shaped head framework 5*b* of the head 5. Furthermore, internal threads 2*e*, into which the joining bolts 7 are screwed, are positioned on the bottom of the head part 2, between the head support member 2*b* and the outer circumference part 2*a*, dividing the circumference of the head part 2 into a plurality (for example six) equal parts (refer to FIG. 3).

The head 5, in this embodiment, comprises a hitting surface member 5*a* comprising of film shaped material formed from synthetic resin and a mesh shaped material knitted out of synthetic fibers bonded to a head framework 5*b*. The head framework 5*b* has a ring shape and is composed of a metal material or the like. The hitting surface member 5*a* is hit by sticks and the like.

The joining bolts 7, in this embodiment, are made of steel, join the hoop 4 to the body part 2 by screwing them together, and impart tension to the head 5 through the hoop 4.

In this embodiment, when assembling the head 5 in an electronic percussion instrument 1, first, place the head 5 (FIG. 1 upper side) on the head support member 2*b* located on the upper side of the body part 2. Next, insert the respective joining bolts 7 into the bolt holes 4*b*, overlay the hoop 4 so as to cover the head framework 5*b* of the head 5, and screw each joining bolt 7 into the internal threads 2*e*.

According to this embodiment, the head 5 is sandwiched between the hoop 4 and the head support member 2*b* providing support. The tension imparted to the head 5 can be adjusted by tightening the joining bolts 7. Furthermore, when a rim shot takes place, because the upper edge of the outer circumferential part 2*a* is hit and the hoop is not hit directly, the joining bolts 7 do not loosen.

The body part 2, in one embodiment, has an attaching part 2*c* protruding from the body for attaching a stand and the like (FIG. 2 lower part). A rod hole 2*f* for receiving a rod-shaped support portion of a stand is inserted therein. A mechanism, such as a threaded set screw may extend into the hole 2*f* to frictionally engage the inserted rod and inhibit relative movement between the rod and the body part 2. A handle 8 may be provided for allowing a user to manually drive that mechanism. This handle is devised so that, when it is turned to the right the rod inserted into the rod hole 2*f* is held and, when it is turned to the left the rod is released.

A head sensor 21 and a rim sensor 31, in one embodiment, are positioned in the inner side of the cylinder that the head support member 2*b* forms, opposite the attaching part 2*c*. The central axis of the cylinder that the body part 2 forms is between the attaching part 2*c* and the head sensor 21 and rim sensor 31. The head sensor 21 is bonded to the top of the support plate 11 extending above two supports positioned in a standing manner with respect to the bottom 2*g* (refer to FIG. 3), and the rim sensor 31 is bonded to the bottom part 2*g*.

Figure 3:
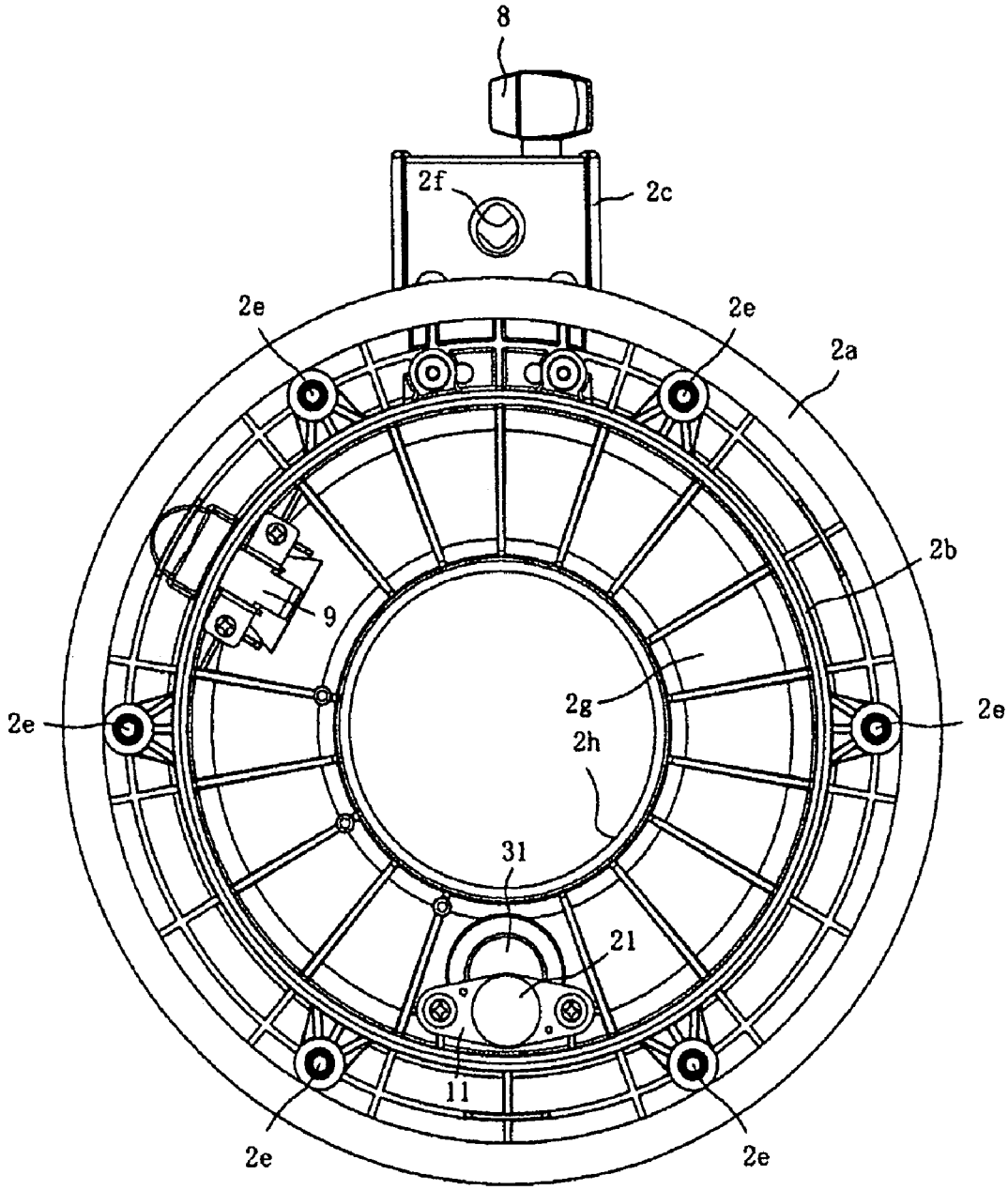
FIG. 3 is a plan view with the hoop taken off of the head of the electronic percussion instrument of FIG. 1.

FIG. 3 is a plan view that shows an electronic percussion instrument 1, when the hoop 4 and the head 5 are removed. In the embodiment shown in FIG. 3, at the upper left side of the center of the body part 2, a stereo jack 9 is provided in order to output the electric signals detected by the head sensor 21 and the rim sensor 31. The electric signals detected by the head sensor 21 and the rim sensor 31 are each independently output by means of a stereo plug inserted into this stereo jack.

Figure 4:
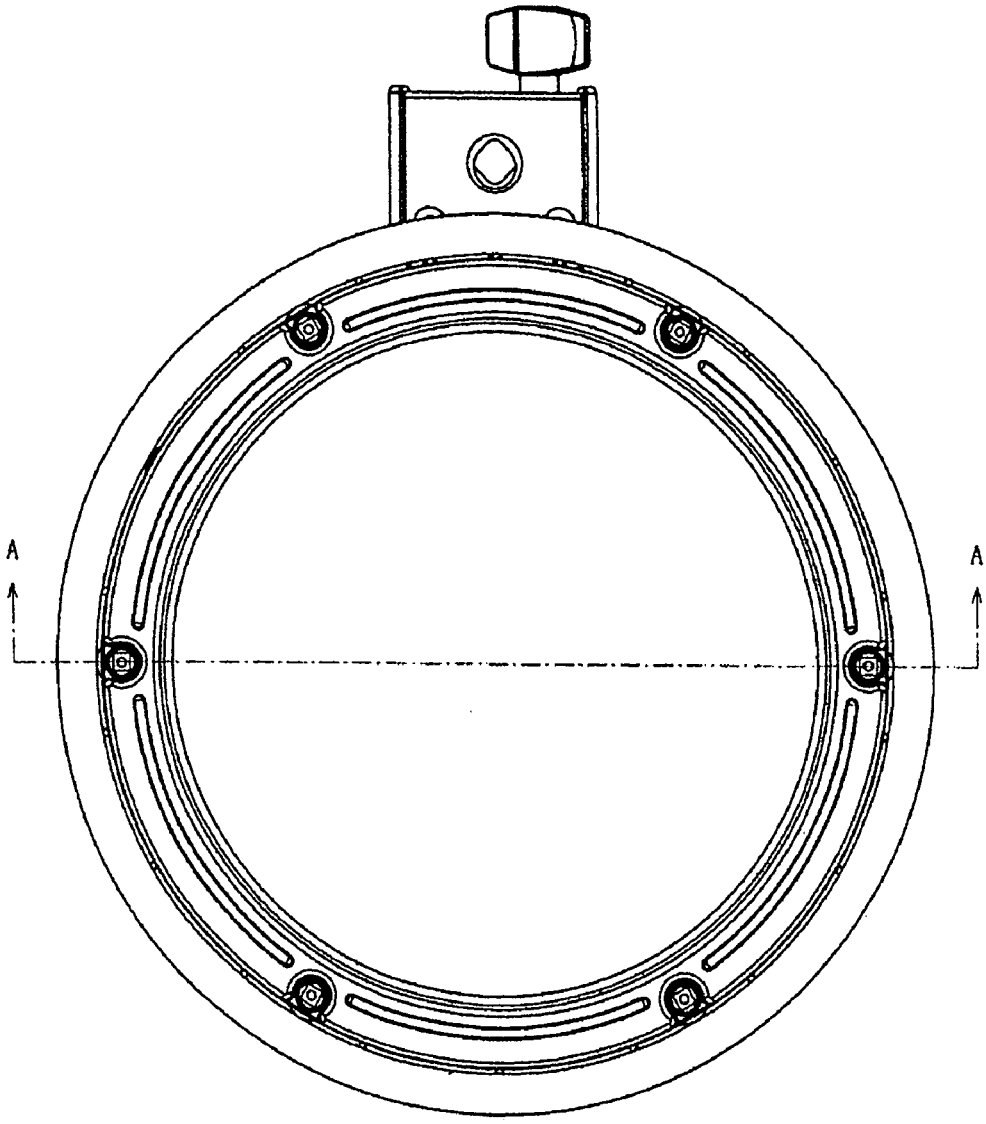
FIG. 4 is a cross-sectional view at a cross-section that includes the joining bolts of the electronic percussion instrument of FIG. 1.
Figure 4:
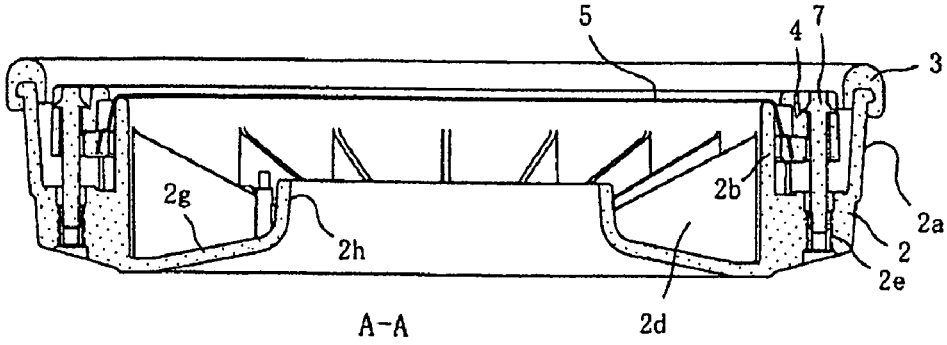

FIG. 4 is a cross-sectional view, cut at a plane perpendicular to the hitting surface 5*a* of the head 5, through the shaft centers of joining bolts 7 of an electronic percussion instrument 1. FIG. 4(*a*) is the plan view that shows the position of the cross-section shown in (b), and FIG. 4(*b*) is that cross-sectional view.

In the embodiment shown in FIG. 4(*b*), the rim cover 3 is mated to the upper edge of the body part 2, and the hitting surface 5*a* is placed lower than the upper edge of that rim cover. The head framework 5*b* contacts the hoop main body 4*a*, and the hoop 4 is pressed down by screwing joining bolts 7 into the internal threads 2*e*.

In this embodiment, the upper surface of the head 5 and the upper surface of the hoop 4 are approximately flush when assembled. Therefore the hitting surface looks uniform at the upper surface of the head 5 and the upper surface of the hoop 4, making the player feel like the hitting area is larger and therefore easier to play.

Furthermore, the bolt holes 4*b* into which the joining bolts 7 are inserted divide the circumference of the hoop 4 into a plurality (such as six) equal divisions in this embodiment. The bolt head accommodating holes 4*c* that accommodate the heads of the joining bolts 7 in the upper part of the bolt holes 4*b*, prevent the heads of the joining bolts 7 from protruding from the upper surface of the hoop 4. Therefore, the hitting surface appears larger.

In a preferred embodiment, the hitting surface member 5*a* is made of a mesh material bonded to a head framework 5*b* that has a ring shape. As shown in FIG. 4, since the head framework 5*b* is fit onto the outer circumference of the head support member 2*b*, the hitting surface member 5*a* extends to the upper edge surface (FIG. 4 upper side) of the body part 2. The head sensor 21 contacts the bottom surface (FIG. 4 lower side surface) of the extended hitting surface member 5*a*.

In the embodiment described above where the hitting surface member 5*a* is comprised of a mesh material, the air resistance of the hitting surface is reduced. This has the advantageous result that the hitting surface feels better when hit by means of sticks and the like, yet the acoustic sound emanating from the hitting surface is reduced, for example, so only the musical note from the speaker equipment may be heard by the player. Examples of heads made of multiple layers of mesh material are described in U.S. Pat. No. 5,920,026, which is incorporated herein by reference. Other suitable mesh head materials have been sold in the United States by Roland Corporation with and for certain products in Roland's V-drum™ line of electronic percussion instruments.

Furthermore, since the vibrations of the hitting surface member 5*a* due to a hit propagate only within the hitting surface member Sa, the influence of that vibration is not substantially imparted to the body part 2. Therefore, such vibrations of the hitting surface member 5*a* are only detected by the head sensor 21 and are not mistakenly detected by the rim sensor 31. Furthermore, the tension of the hitting surface member 5*a* can be arbitrarily adjusted to accommodate the playing method of the user by changing the degree to which the jointing bolts 7 are screwed into the internal threads 2*e*.

Figure 5:
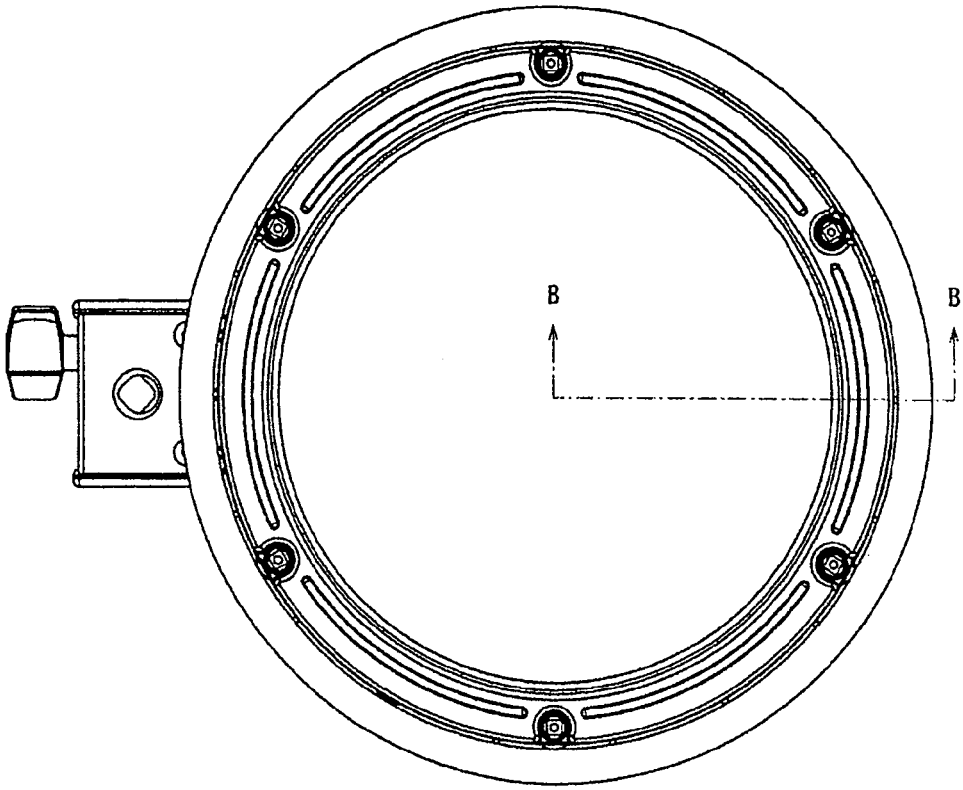
FIG. 5 is a cross-sectional view of a sensor part of the electronic percussion instrument of FIG. 1.
Figure 5:
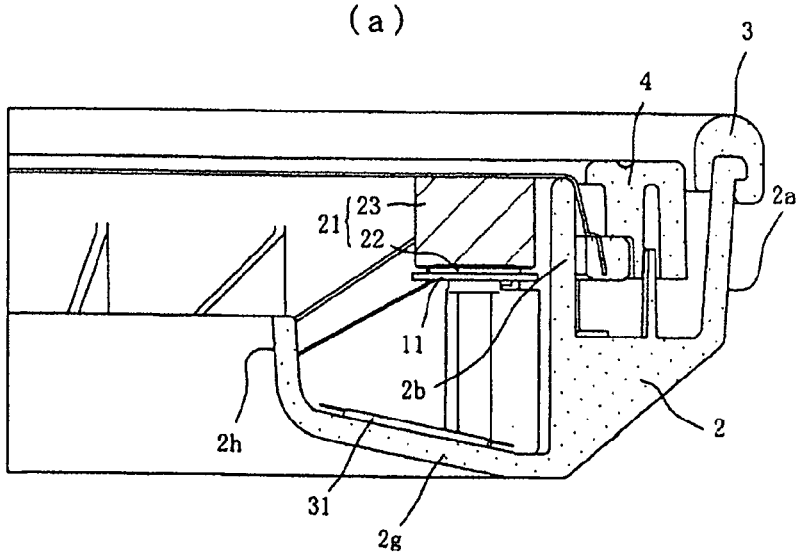

Next, an example embodiment of the head sensor 21 and the rim sensor 31 will be explained with reference to the embodiment shown in FIG. 5. FIG. 5(*a*) is a plan view that shows the position of the cross-section shown in (b), and FIG. 5(*b*) is that cross-sectional view.

The head sensor 21 comprises a sensor device used for detecting the vibrations of the head 5 and, in one embodiment, comprises a piezoelectric device 22 and cushioned double-sided tape. The piezoelectric device 22 and the like may be covered by a cushion member 23. The piezoelectric device 22 is a vibration detection sensor that converts piezo and the like vibrations to electric signals. The piezoelectric device 22 may be formed in a disk shaped body and has an output signal line (not shown). The upper and lower surfaces of the piezoelectric device 22, the cushioning member 23, and the cushioned double-sided tape are each attached by a suitable adhesive material.

The output signal line is connected to the stereo jack 9 (refer to FIG. 3), and the electric signal from the piezoelectric device 22 may be output to a musical note device (not shown) via the stereo jack 9.

The cushioned double-sided tape, in a preferred embodiment, has adhesive material for adhering the piezoelectric device 22 to the support plate 11 and comprises double-sided tape with an adhesive layer laminated on the upper and lower surfaces of a cushioning layer. In this embodiment the cushioned double-sided tape is formed in approximately a disk shape, and the piezoelectric device 22 is stuck to the support plate 11 by means of this cushioned double-sided tape.

The cushion member 23 transmits vibrations from the head 5 to the piezoelectric device 22. In the embodiment of FIG. 5*b*, the cushion member 23 may comprise an approximately cylindrical shaped elastic member made of polyurethane foam or other suitable sponge-like material, or the like. The cushion member 23 is stuck to the piezoelectric device 22 and in one embodiment has a diameter larger than that of the piezoelectric device 22. The cushion member is positioned so that the upper surface of the cylindrically shaped body of the cushion member contacts the lower surface of the head 5 (hitting surface member 5*a*).

A head sensor 21 may be secured to the top of a support member 11 by cushioned double-sided tape, with the upper surface of the cushion member 23 in contact with the lower surface of the head.

The rim sensor 31, in one embodiment, comprises a sensing device used to detect the vibrations of the outer circumferential part 2*a* of the body part 2 and, similar to the above mentioned embodiment of the head sensor 21, has a piezoelectric device as a vibration detection sensor and cushioned double-sided tape for the purpose of securing the piezoelectric device to the bottom part 2*g*. An explanation of the piezoelectric device and cushioned double-sided tape and the like is omitted because it is the same description as that of the head sensor 21.

In one embodiment the rim sensor 31 is secured to the upper side of the bottom part 2*g* by means of cushioned double-sided tape. The secured position of this rim sensor 31 is in the vicinity of the head sensor 21 and is a position on the side opposite the attaching part 2*c* with the central axis of the cylinder that forms the body part 2 interposed in between.

In the above mentioned embodiment, the rim part formed in the body part 2 does not have to impart tension to the head 5 (which is provided by a hoop 4 that is a separate member), so the height of the upper edge of the rim part from the upper surface of the head 5 may be uniform and constant. Therefore a rim shot can more easily be played.

In prior embodiments where the outer circumference of the head 5 is surrounded by the rim part, the vibration from a rim shot propagated to the head 5 may be mistakenly detected by the head sensor. In the above mentioned embodiment of the present invention, the rim part does not directly touch the head 5, preventing false detection of a rim shot by the head sensor.

An explanation of the present invention was given above of the present invention based on several preferred embodiments. However, the present invention is in no way limited to the preferred embodiments described above. Various modifications and changes that do not deviate from and are within the scope of the essentials of the present invention can be easily surmised For example, in the preferred embodiments described above, the rim part comprises a rubber rim cover 3 that fits on to the outer circumferential part 2*a* but the rim cover 3 may also be omitted.

What is claimed is:

1. An electronic percussion instrument that detects vibration due to hits and outputs a corresponding signal comprising:

a body having a hollow circular cylindrical shape with an outer circumference and an inner circumference, the body further having a rim part with an upper edge on the outer circumference;

a head having a generally flat surface with a lower surface and an upper surface positioned lower than the upper edge of the rim part and inside the inner circumference of the body, the head further having an inner circumference and an outer circumference;

a head support member having a generally cylindrical shape and positioned within the inner circumference of the body, the head support member is arranged to contact the inner circumference of the lower surface of the head;

a hoop part having a ring shape that surrounds the outer circumference of the head and provides tension to the head at the inner circumference of the body, the hoop part further having an upper surface and a lower surface;

a head sensor arranged to detect vibrations of the head;

a frame connected to the head support member; a plurality of bolts arranged to secure the hoop part to the body, the bolts threaded to a plurality of internal threads formed in the frame; and a generally annular rib on the body between the rim part of the body and the head support member;

the hoop part having bolt head accommodating holes for receiving heads of the bolts so that the heads of the bolts do not protrude from the upper surface of the hoop part; and the hoop part further having a generally annular slot in which the generally annular rib is received.

2. The electronic percussion instrument according to claim 1, wherein the upper surface of the hoop part is substantially flush with the upper surface of the head.

3. The electronic percussion instrument according to claim 1, wherein the body and head support member arc formed in one unitary body made of resin.

4. The electronic percussion instrument according to claim 1, further comprising a rim sensor that detects vibrations of the body located in the vicinity of the head sensor.

5. The electronic percussion instrument according to claim 1, further comprising an attaching part that holds the body, the attaching part is positioned on the outer circumference of the body, and the head sensor is positioned on a side opposite the attaching part with a central axis of the circular cylindrical shape of the body interposed between the head sensor and the attaching part.

6. The electronic percussion instrument according to claim 5, further comprising a rim sensor that detects vibrations of the body located in the vicinity of the head sensor.

7. The electronic percussion instrument according to claim 6, the central axis of the circular cylindrical shape of the body interposed between the attaching part and both the head sensor and the rim sensor.

8. The electronic percussion instrument according to claim 5, wherein the head is made of mesh material having threads arranged at right angles to each other; and wherein the threads are made of resin.

9. The electronic percussion instrument according to claim 8, wherein the head comprises two layers of mesh material.

10. The electronic percussion instrument according to claim 1, wherein the head is made of mesh material having threads arranged at right angles to each other, wherein the threads are made of resin.

11. The electronic percussion instrument according to claim 10, wherein the head comprises two layers of mesh material.

12. The electronic percussion instrument according to claim 1, the rim part comprising a cover attached to a portion of the outer circumference of the body.

13. The electronic percussion instrument according to claim 1, the rim part of the body and the head support member formed as a single, unitary structure.

14. The electronic percussion instrument according to claim 1, in which the generally annular rib comprises a plurality of rib sections in a generally annular arrangement.

15. An electronic percussion instrument that detects vibration due to hits and outputs a corresponding signal comprising:

a body with an inner area and an outer surface, the body further having a rim part;

a head with an upper surface and lower surface, the head further having an inner area and an outer area;

a head support member arranged to provide a force to the lower surface of the head;

a head tension member arranged to provide a force to the upper surface of the head, the head tension member further having an upper surface and a lower surface;

a head sensor arranged to detect vibrations of the head;

a frame connected to the head support member;

a plurality of bolts arranged to secure the head tension member to the body, the bolts are threaded to a plurality of internal threads formed in the frame; and a generally annular rib on the body between the rim part of the body and the head support member;

the rim part arranged to not directly contact the head;

the head positioned in an area closer to a central axis of the body than the rim part;

the force from the head tension member for providing tension to the head; and the head tension member having bolt head accommodating holes for receiving heads of the bolts, so that the heads of the bolts do not protrude from the upper surface of the head tension member; and the head tension member further having a generally annular slot in which the generally annular rib is received.

16. The electronic percussion instrument according to claim 15, further comprising an attaching part that holds the body, the attaching part is positioned on the outer surface of the body, and the head sensor is positioned on a side opposite the attaching part with the central axis of the body interposed between the head sensor and the attaching part.

17. The electronic percussion instrument according to claim 16, further comprising a rim sensor that detects vibrations of the body, the central axis of the body interposed between the attaching part and both the head sensor and the rim sensor.

18. The electronic percussion instrument according to claim 15, further comprising a rim sensor that detects vibrations of the body.

19. The electronic percussion instrument according to claim 15, wherein the head is made of a mesh material having threads arranged at angles to each other.

20. The electronic percussion instrument according to claim 19, wherein the head comprises two layers of mesh material.

21. The electronic percussion instrument according to claim 15, wherein the upper surface of the head tension member is substantially flush with the upper surface of the head.

22. The electronic percussion instrument according to claim 15, the rim part comprising a cover attached to a portion of the outer surface of the body.

23. The electronic percussion instrument according to claim 15, in which the generally annular rib comprises a plurality of rib sections in a generally annular arrangement.

24. A method of manufacturing an electronic percussion instrument that detects vibration due to hits and outputs a corresponding signal, the method comprising:

providing a body part forming an area, the body part further having a center and an outer surface;

locating a head with within the area formed by the body part, the head further having an upper surface and a lower surface, the head further having an inner edge and an outer edge;

positioning a rim part on the body part at a distance further from the center of the body part than the distance of the outer edge of the head from the center of the body part;

supporting the lower surface of the head with a head supporting member;

providing a generally annular rib on the body between the rim part and the head support member;

providing a head tension member having a generally annular slot and arranging the head tension member to receive the generally annular rib within the generally annular slot, the head tension member further having an upper surface and a lower surface;

imparting a force on the upper surface of the head with the head tension member;

creating tension in the head through the force from the head tension member; and locating a head sensor to detect vibrations of the head;

wherein creating tension in the head through the force from the head tension member comprises:

connecting a frame to the head support member; and securing the head tension member to the body part by arranging a plurality of bolts that are threaded to a plurality of internal threads formed in the frame;

wherein securing the head tension member comprises providing bolt head accommodating holes for receiving heads of the bolts on the head tension member so the heads of the bolts do not protrude from the upper surface of the head tension member.

25. The method according to claim 24, further comprising positioning an attaching part on the outer surface of the body part, the attaching part for holding the body part.

26. The method according to claim 25, wherein locating a head sensor comprises positioning the head sensor on a side opposite the attaching part with a central axis of the body part interposed between.

27. The method according to claim 25, further comprising locating a rim sensor that detects vibrations of the body part;

wherein locating a rim sensor and locating a head sensor comprises interposing a central axis of the body part between the attaching part and both the head sensor and the rim sensor.

28. The method according to claim 24, further comprising locating a rim sensor that detects vibrations of the body part.

29. The method according to claim 24, wherein locating a head within the area formed by the body part comprises forming the head from a mesh material within the area formed by the body part.

30. The method according to claim 24, wherein locating a head within the area formed by the body part comprises forming the head from two layers of a mesh material within the area formed by the body part.

31. The method according to claim 24, wherein locating a head within the area formed by the body part comprises positioning the upper surface of the head so it is flush with the upper surface of the head tension member.

32. The method according to claim 24, wherein positioning a rim part comprises providing a cover attached to a portion of the outer surface of the body part.

33. An electronic percussion instrument that detects vibration due to hits and outputs a corresponding signal comprising:

a body having a hollow circular cylindrical shape with an outer circumference and an inner circumference, the body further having a rim part with an upper edge on the outer circumference;

a head having a generally flat surface with a lower surface and an upper surface positioned lower than the upper edge of the rim part and inside the inner circumference of the body, the head further having an inner circumference and an outer circumference;

a head support member having a generally cylindrical shape and positioned within the inner circumference of the body, the head support member is arranged to contact the inner circumference of the lower surface of the head;

a generally annular rib on the body between the rim part of the body and the head support member;

a hoop part having a ring shape that surrounds the outer circumference of the head and provides tension to the head at the inner circumference of the body, the hoop part further having an upper surface and a lower surface, the hoop part further having a generally annular slot in which the generally annular rib is received; and a head sensor arranged to detect vibrations of the head;

wherein the upper surface of the hoop part is substantially flush with the upper surface of the head.

34. The electronic percussion instrument according to claim 33, the outer circumference of the body having a height dimension greater than a height dimension of the inner circumference of the body.

35. The electronic percussion instrument according to claim 33, the rim part of the body and the head support member formed as a single, unitary structure.

36. The electronic percussion instrument according to claim 33, the inner circumference of the body defines an inner circumferential wall and the hoop part is configured to provide tension in a direction substantially parallel to the inner circumference of the body.

37. The electronic percussion instrument according to claim 33, the hoop part configured to be selectively adjustable to vary the tension provided to the head.

* * * * *